US005217229A

United States Patent [19]

Jaime

[11] Patent Number: 5,217,229

[45] Date of Patent: Jun. 8, 1993

[54] FOOTBALL BOARD GAME

[76] Inventor: Francisco Jaime, 3528 S. Archer Ave., Chicago, Ill. 60609

[21] Appl. No.: 909,196

[22] Filed: Jul. 6, 1992

[51] Int. Cl.[5] ..... A63F 3/00

[52] U.S. Cl. ..... 273/247

[58] Field of Search ..... 273/247, 94 R

[56] References Cited

U.S. PATENT DOCUMENTS

| | | | |
|---|---|---|---|
| 1,562,866 | 11/1925 | Burgess | 273/94 R |
| 2,587,242 | 2/1952 | Stringer | 273/94 R |
| 3,887,191 | 6/1975 | Lucas | 273/247 |
| 4,003,580 | 1/1977 | Haffey | 273/247 |
| 4,094,509 | 6/1978 | Barron | 273/247 |
| 4,524,975 | 6/1985 | Caughie et al. | 273/247 |
| 4,706,959 | 11/1987 | Price | 273/247 |
| 4,773,650 | 9/1988 | Doughty | 273/247 |

*Primary Examiner*—Benjamin H. Layno

*Attorney, Agent, or Firm*—Henderson & Sturm

[57] ABSTRACT

A board game for playing a simulated football game. The game board includes a representation of a football field having yard line and goal line indicia. An offensive play chart is disposed on the board and has a number of associated offensive playing pieces, each indicating a selected offensive play. A defensive play chart is also disposed on the board having a number of associated defensive playing pieces, each playing piece indicating a selected defensive play. A pair of yardage dice with indicia associated with yardages are shown on the defensive play chart. A field goal chart is disposed on the board having an associated die selected from a number of field goal dice and determined by an offensive player's position on the field. An extra point chart having an associated extra point die, and a kick-punt chart having an associated kick-punt die are also disposed on the board.

8 Claims, 3 Drawing Sheets

FOOTBALL BOARD GAME

TECHNICAL FIELD

This invention relates to board games, and more particularly to a board game simulating a professional or collegiate ball game.

BACKGROUND ART

There are a number of board games available which utilize a play selection method which attempts to simulate the situations that typically are found in a real football game. Most of the available board games combine some degree of skill in play selection with the element of chance. All presently known games, however, lack the diversity inherent in an actual football game.

Those concerned with these and other problems recognize the need for an improved football board game.

DISCLOSURE OF THE INVENTION

The present invention provides a board game for playing a simulated football game. The game board includes a representation of a football field having yard line and goal line indicia An offensive play chart is disposed on the board and has a number of associated offensive playing pieces, each indicating a selected offensive play. A defensive play chart is also disposed on the board having a number of associated defensive playing pieces, each playing piece indicating a selected defensive play. A pair of yardage dice with indicia associated die selected from a number of field goal dice and determined by an offensive player's position on the field. An extra point chart having an associated extra point die, and a kick-punt chart having an associated kick-punt die are also disposed on the board.

An object of the present invention is the provision of an improved football board game.

Another object is to provide a football board game which incorporates most of the events which typically occur in an actual game.

BRIEF DESCRIPTION OF THE DRAWINGS

These and other attributes of the invention will become more clear upon making a thorough review and study of the following description of a preferred embodiment, particularly when reviewed in conjunction with the drawings, wherein.

BEST MODE FOR CARRYING OUT THE INVENTION

Figure 1:
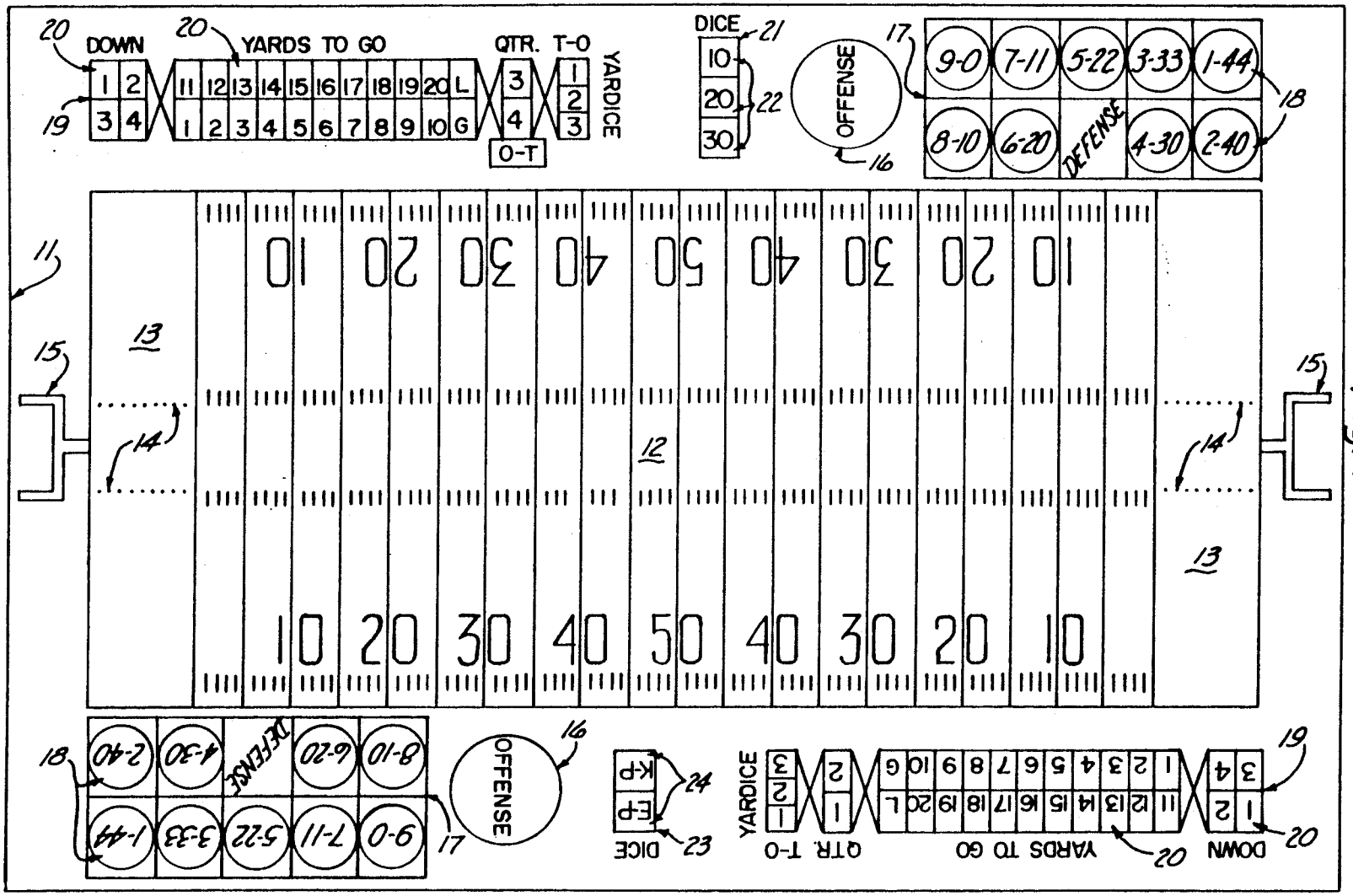
FIG. 1 is a plan view of the surface of the preferred embodiment of the playing board of the present invention.

Referring now to the drawings, wherein like reference numerals designate identical or corresponding parts throughout the several views, FIG. 1 shows a preferred embodiment of the playing board (11) of the present invention. The playing board (11) includes a football field (12) having two end zones (13), each end zone containing eleven pairs of touchdown dots (14).

Outside the football field (12), the playing board (11) has two goal posts (15), two offense play charts (16), two defense play charts (17), two marker of downs charts (19) and two dice charts (21, 23). Each offensive play chart (16) contains the word "OFFENSE" and is associated with an offensive play to be set out on the chart with a playing piece (26). Each defense play chart (17) contains the word "DEFENSE" and a plurality of indicia (18), preferably in the form of rectangles with numbers, the numbers being associated with the roll of the dice (29, 32). Each chart is associated with a defensive play to be set out on any rectangle of the chart with a playing piece (27). Each marker of downs chart (19) contains a plurality of indicia (20) in the form of numbers and letters, each number and letter (20) being associated with a "down" (and quarter and time-out) situation, each "down" situation to be set out on the marker of downs chart with playing pieces (53) in every play. The dice chart (21) contains indicia (22) preferably in the form of numbers, each number being associated to a die (35, 38, 41). The dice chart (23) contains indicia (24) preferably in the form of letters, the letters being associated to a die (44, 47).

Figure 2A:
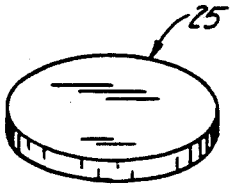
FIG. 2A is a preferred form of representative playing pieces of the present invention.
Figure 2B:
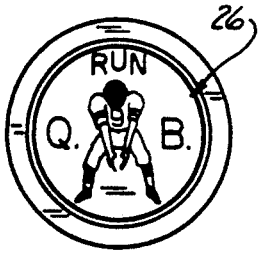
FIG. 2B is a top plan view of a playing piece representing an offense play of the present invention.
Figure 2C:
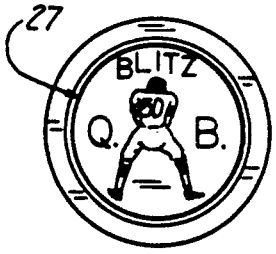
FIG. 2C is a top plan view of a playing piece representing a defense play of the present invention.

FIG. 2 illustrates a preferred form of representative playing pieces (25) (called "chips"). Each playing piece (25) bearing on its upper surface a descriptive play (each play depicting a football player), either an offense play (26) or a defense play (27). A preferred set of ten playing pieces (25) is used by each player, five playing pieces (25) for offense plays (26) and five playing pieces for defense plays (27).

Figure 3:
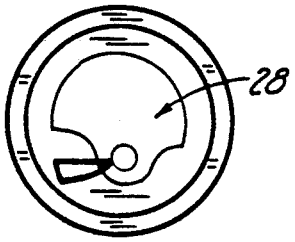
FIG. 3 is a bottom plan view thereof.

FIG. 3 illustrates a playing piece (25) depicting a football helmet (28) on its lower surface. All playing pieces (25) depict the drawing of a football helmet (28) on the lower surface thereof; however, one player's set of ten playing pieces (25) is different in color from the other player's set.

Figure 4:
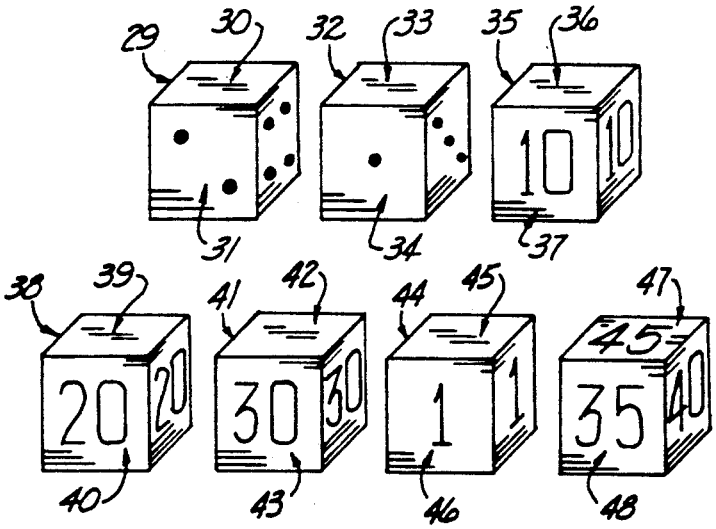
FIG. 4 is a perspective view of the preferred set of dice.

FIG. 4 illustrates the set of six-sided dice used in the present invention. The set includes a preferred white die (29) (called "yardie"), which has one blank side (30) and the remaining five sides marked from one to five, one number on each side as the one shown at (31). A preferred black die (32) (called a "yardie") has two blank sides (33), and the remaining four sides marked from one to four, one number on each side as the one shown at (34). A preferred brown die (35) (called "field goal die number 10") has one blank side (36) and the remaining five sides marked with the number "10," one number on each side as the one shown at (37). A preferred brown die (38) (called "field goal die number 20"), has two blank sides as the one shown at (39), and the remaining four sides marked with the number "20," one number on each side as the one shown at (40). A preferred brown die (41) (called "field goal die number 30"), has three blank sides as the one shown at (43). A preferred brown die (44) (called "extra point die") has one blank side (45) and the remaining five sides marked with the number "1," one number on each side as the one shown at (46). A preferred brown die (47) (called "kick-punt die"), has numbers "35, 40, 45, 50, 55, 60," one number on each side as the one shown at (48).

Figure 5:
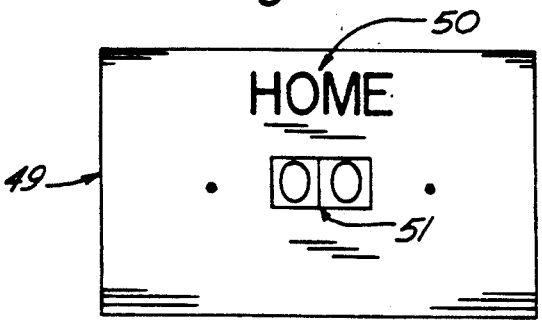
FIG. 5 is a plan view of a preferred score board card of the present invention.

FIG. 5 shows a score board (49) as used in accordance with the present invention. Each score board card contains the word "HOME" (50), or "VISITOR" as shown. The score board card (49) is used to mark the score (51) during the game.

Figure 6A:
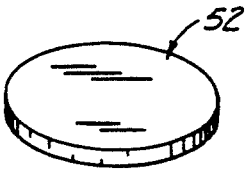
FIG. 6A is a preferred from of representative chips of the present invention.
Figure 6B:
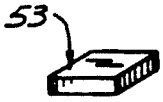
FIG. 6B is a preferred form of representative down marking pegs of the present invention.
Figure 6C:
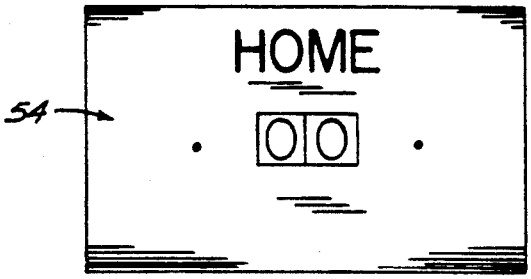
FIG. 6c is a preferred form of representative score board cards of the present invention.

FIG. 6 illustrates chips (52), marking pegs (53), and score board cards (54) which are also part of the game.

Figure 7:
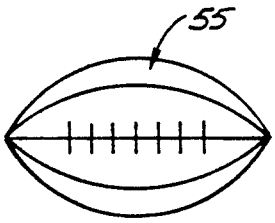
FIG. 7 is a plan view illustrating a preferred form of a playing piece of the present invention.

FIG. 7 illustrates playing piece (55) in the form of a football as used in accordance with games rules.

Figure 8:
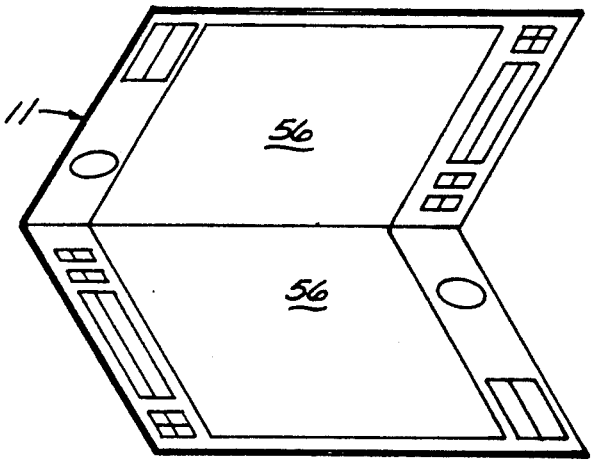
FIG. 8 is a view of the playing board of the present invention illustrating the manner in which the board may be folded.

FIG. 8 illustrates the playing board (11) with fold (56) down the middle thereof for ease in folding the board (11) in half for storage.

Figure 9A:
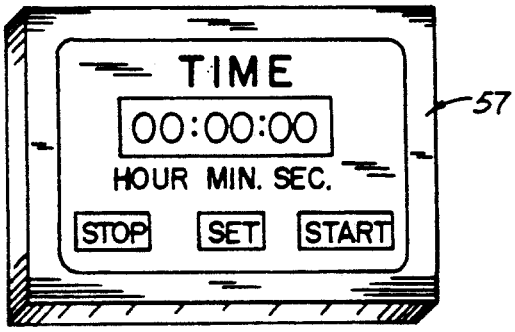
FIG. 9A illustrates a timer used in accordance with the present invention.
Figure 9B:
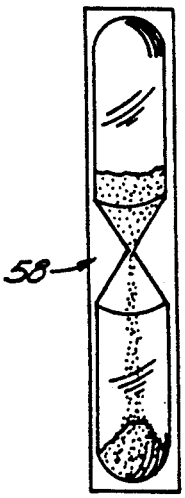
FIG. 9B illustrates a time-out timer used in accordance with the present invention.

FIG. 9 illustrates a timer (57) and time-out timer (58) for use with the game.

The basic objective of the game is to score as many points as possible before the time expires. To accomplish the objective, the players use game rules, charts, chips, dice and other factors such as a "guess system," luck, strategy and time. To play the game, the players must have knowledge of the basic rules of football.

According to the rules of the game, the invention is played between two or more players in teams. Each player, or team, is given 10 chips (52) (5 for offense, (5 for defense), three marking pegs, and one score board card. To start the game, the players set up the playing board as follows:

1. The playing board is placed in such a way so that each player is at each end of the playing board (by goal posts) and facing against each other. Each player moves his marking pegs on the marker of downs chart during every play.

2. The dice are placed on the respective charts.

3. The marking pegs are placed on the respective marker of down charts. To mark during the game, the situation of every down, quarter and time out (1st and 10, one peg on "down 1," another on "10," when a time out is called, another peg is placed on "time out" on the respective number, the extra peg is used to mark the quarter).

4. The score board cards are placed by the middle, outside the playing board.

5. The timers are placed next to the score board cards. The timer is set to the respective time.

6. When rolling the dice, the numbers and blanks must be clear and visible to the players after the roll, if not, the roll must be repeated. If a die falls from the playing surface, both dice (yardice) or die must be rolled again.

After the playing board has been set up, the players select offense and defense by tossing a coin or the like.

According to the preferred rules of the game, the offense player has control of the dice and the football To use them in accordance to game rules, when the offense player becomes defense, the defense player becomes offense and gets control of the dice and the football. The defense player sets the timer to STOP or to RUN (START) during the game in every play or down. When both players have decided the situation, completion, incomplete, sack fumble, etc., of a play, the defense player makes the proper setting on the timer, either stops it or keeps it running in accordance to the situation. When the timer is set on STOP, the defense sets it to RUN at the time that the offense player picks up the dice to be rolled.

According to the preferred rules of the game, the use and function of the items of the invention are as follows:

CHIPS—Each player is given a set of ten chips, 5 for offense, 5 for defense with the preferred following plays:

| Offense play chips: | Defense play chips: |
|---|---|
| Run - Q.B. | Blitz - Q.B. |
| Run - F.B. | Tackle - F.B. |
| Run - R.B. | Tackle - R.B. |
| Pass - T.E. | Cover - T.E. |
| Pass - W.R. | Cover - W.R. |

Q.B. stands for quarterback; F.B. stands for fullback; R.B. stands for running back; T.E. stands for tight end; and W.R. stands for wide receiver.

To set up a play, each player selects a chip and places it on the respective chart facing downwards with the drawing of the helmet facing upwards. The selection of the playing chip is made in such a manner so that the opposite player does not see the play of the selected chip. After rolling the yardice (29), 32), the offense player shows his play first. The defense player shows his play afterwards. A play cannot be changed once it has been set on the chart unless a time out is called.

Yardice is the name give to the main pair of dice. The main pair of dice are one white and one black. They are always rolled together, except on a bomb play. After each roll, the numbers of both dice are added to obtain the total amount or yardice number. The white die has one blank side (30) and when rolled its number always count as units (1=1; 2=2; 3=3; 4=4; 5=5; blank=0). The black die has two blank sides and its number also count as units when rolled, but its number is multiplied by ten (1=10; 2=20; 3=30; 4=40; blank=0). Only when the white die is blank or when both numbers of the dice (the white and the black) are the same (double) there are only 18 different numbers a play can get when rolling the yardice. These 18 numbers are 0, 1, 2, 3, 4, 5, 6, 7, 8, 9, 10, 11, 20, 22, 30, 33, 40 and 44. These 18 numbers are also associated to the rectangles of the defense play charts (FIG. 1). Each rectangle contains a set of two different numbers. The only time that the yardice number count as units from 0 to 9, even if its a double, or even if the white die is blank, is when a player makes a sack or when a player sets the play RUN-Q.B.

The field goal dice numbers 10, 20, 30 (FIG. 4) are used only by the offense player. These dice are used to attempt to score a field goal. To score a field goal, the football (55) has to be within field goal range. The field goal range is divided into three sections as follows: 1st—section from the 1 to the 19 yard line (die #10); 2nd—section from the 20 to the 29 yard line (die #20); and 3rd—section from the 30 to the 39 yard line (die #30).

The field goal range is not marked on the football field (12). These three sections are used only as a reference in a field goal situation. The field goal range will always be on the defense players side at the time of the situation. To attempt to score a field goal, the offense player rolls only one field goal die per attempt. The selection of the die is made in accordance to the 1st, 2nd or 3rd section where the football is at. After the selection of the field goal die has been made, the offense player rolls the die. If after the roll, the die shows the respective number (10, 20, 30), the attempt is good. If it shows a blank side, the attempt is not good. A good attempt with any field goal die is worth three points. After a field goal has been scored, the offense player kicks the football from his own 35 yard line (see KICK). If the offense player does not score the field goal with a #20 or #30 die, the defense player gets the football (55) in the yard line from where the offense player attempted to score. If the offense player does not score the field goal with a #10 die, the defense player gets the football on his own 20 yard line. The timer stops after each field goal attempt.

The extra point die (44) (EP) (FIG. 4) is used only after a touchdown has been scored. When a player scores a touchdown, the football (55) is placed on the 10 yard line of the defense player. From there the scoring player can choose to attempt to score 1 or 2 extra points. To score 1 extra point, the scoring player rolls the extra point die (44). If after the roll it shows the number 1, the attempt is good. If it shows the blank side (45), the attempt is not good. To score 2 extra points, the scoring player rolls the yardice one time. If after the roll, the yardice shows the numbers 10, 11 or 20, the attempt is good. If the yardice shows any other numbers, the attempt is not good. After an attempt for 1 or 2 extra points, whether its good or not, the scoring player kicks the football (55) from his own 35 yard line. If a player forgets to roll the EP (44) after a touchdown, the attempt is considered as missed or blocked. The blank sides on the extra point and field goal dice represent a missed or blocked attempt. After a good field goal, or after a good extra point attempt, the offense player places the football (55) inside the respective goal post (15).

The kick and punt die (47) (KP) (FIG. 4) is used to kick or to punt the football (55). After the roll, the number that the die (47) shows 35, 40, 45, 50, 55 or 60, represents the amount of yards of the kick or punt after each kick and punt. The timer keeps running, the timer stops only if the football lands out of the field, out of bounds, or when a punt return is declined.

The preferred rules of the game of the present invention describe the Q.B. Rule, the 10-11-20 Rule, the Match-Up Rule and definitions of how the players can make the following situations. Touchdowns, field goals, extra points, completions, incomplete runs or passes, sacks, safeties, fumbles, interceptions, interception returns, free kicks, punts, punt returns, touchbacks, kicks, kick returns, onside kicks, penalties, over-throw runs or passes, bomb plays, reverse plays, lateral plays, the duration time of the game is also described. For field goals and extra points, see field goal dice, extra point die and yardice.

Q.B. RULE—The players can only run or sack the Q.B. from 0 to 9 yards. In a Run-Q.B. play or in a sack situation, the numbers on the yardice count as units even if its a double or even if the white die is blank. In a Run-Q.B. play, or in a sack situation, the yardice number never changes (counts as units) for match-up purposes. It only counts as units to count the gained or lost yards.

10-11-20 RULE—When a player scores a touchdown, the football is placed on the defense 10 yard line from where the scoring player can choose to score 1 or 2 extra points. To score 1 extra point, the scoring player rolls the extra point die. To score 2 extra points, the scoring player rolls the yardice one time per attempt and he has to get a number 10, 11 or 20 to score. Since the football is on the 10 yard line, any other number is too short or too long.

MATCH-UP RULE—In order to stop the advance drive of the offense player, the defense player has to guess either the correct play or the correct yardice number or both. When the player guesses correctly, either one or both is called a match-up. To match-up the offense play, the defense player has to get the matching play. According to the preferred rules, the matching plays are as follows: Blitz-Q.B. to match-up Run-Q.B.; Tackle-F.B. to match-up Run-F.B.; Tackle-R.B. to match-up Run-R.B.; Cover-T.E. to match-up Pass-T.E.; and Cover-W.R. to match-up Pass-W.R.

To match-up the yardice number of the offense player, the defense player sets his play on one of the rectangles of the defense play chart (17) (FIG. 1). The defense player can set his play on any rectangle, but only on one per play or down after the roll of the yardice made by the offense player. If the defense play is on the rectangle that matches the yardice number, its a Match-Up.

The definitions of the situations for the game are as follows:

TOUCHDOWN—When the offense player takes the football into the defense end zone via Run-play or Pass-play, or via kick or punt or interception return, its a Touchdown. After counting the yardice number, the football has to land exactly on any of the eleven touchdown dots (14) (FIG. 1). The offense player gets 6 points.

COMPLETION—When the defense player does not match-up either the play or the yardice number of the offense player, its a Completion. The timer stops only if the yardice number is even. The offense advances the football in accordance to the yardice.

INCOMPLETE RUN OR PASS—When the defense does match-up either the play or the yardice number of the offense, its an incomplete run or pass. The defense does not advance the football. In an incomplete run-play the timer keep running. In an incomplete pass-play, the timer stops.

SACK—When the defense sets a Blitz-Q.B. play and does match-up the yardice number of the offense, its a sack, the timer keeps running. The offense loses yards in accordance to the number of the yardice. In a sack situation, the yardice number count as units, the yardice number does not count as units for match-up purposes. It only does count the lost yards from 0 to 9 (see Q.B. Rule).

SAFETY—When the defense makes a sack on any of the eleven touchdown dots in the end zone of the offense, its a Safety. The timer stops. The defense gets 2 points and the football. The offense kicks (see free kick) the football from his own 20 yard line.

FUMBLE—When the defense does match-up both the play (only the run-plays) and the yardice number of the offense, its a Fumble. The timer stops. The offense does not gain or lose any yards. In a fumble situation, if the yardice number is odd, 5, 11, 33, etc., the offense does not advance, but recovers the football and continues the drive in accordance to the down. If the yardice number is even, 0, 8, 44, etc., the offense does not advance and loses the football. The defense gets the football in the yard line where the offense lost it.

INTERCEPTION—When the defense does matchup both the play (pass plays only) and the yardice number of the offense, its an interception. The offense gains the yards (if any), but loses the football. In an interception, the offense advances the football in accordance to the yardice number, but the defense gets the football after the count. The timer keeps running. If the defense intercepts the football between the 34 and the 1 yard line of the offense (1st; section), the defense does not make an interception return (see interception return). If the defense intercepts the football between his own 20 and the offense 35 yard line (2nd section), the defense makes an interception return. If the defense intercepts the football between his own 19 yard line and his own end zone (3rd; section), the defense makes an interception return.

INTERCEPTION RETURN—To make an interception return, the defense rolls the yardice one time (2nd; and 3rd; section only). The defense has to roll the yardice a second time only if he rolls a "double 4" (44) the first time, and only if the interception occurs on the 3rd; section. When the defense intercepts the football on his own end zone, he can choose to decline or to make an interception return. If he declines, the timer stops, and he starts the drive from his own 20 yard line. If he chooses to make an interception return, the timer keeps running, then he rolls the yardice and starts to count the amount of the yardice number from his own 1 yard line. After the count, the timer stops, then he starts the drive. The total number of the yardice, of one or two rolls, represents the amount of yards of the interception return.

FREE KICK—When the defense scores a safety the offense kicks (free kick) the football from his own 20 yard line (see kick).

PUNT—In a 4th; down situation, the offense can choose whether to go for a 1st; down, or to attempt to score a field goal (if the football is within field goal range) or to punt. To punt, the offense rolls the kick-punt die one time per punt, and the number it shows after the roll, 35, 40, etc., represents the amount of yards of the punt. The timer keeps running. If after a punt, the football lands out of bounds, its a touchback (see TOUCHBACK) and there is no punt return. The timer stops. The receiving player starts the drive from his own 20 yard line. If after a punt, the football lands on the end zone, the receiving player can choose whether to decline or to make a punt return. If he declines, the timer stops. Then he starts the drive from his own 20 yard line. When making a punt return in which the football has landed on the end zone, the timer keeps running. The player starts the count of the punt return from his own 1 yard line after the count, the timer stops, then he starts the drive (see PUNT RETURN).

PUNT RETURN—To make a punt return, the receiving player rolls the yardice one time after each punt. The receiving player has to roll the yardice a second time only if he rolls a "double 4" (44) the first time. The total number of the yardice (of one or two rolls), represents the amount of yards of the punt return. After a punt return, the timer stops, then the punt return player starts the drive. If after counting the total yardice number of a punt return the football lands on the end zone of the punting player, the punt return player scores a touchdown. If after counting the total yardice number of a punt return, the football lands out of bounds, it's a touchback, the timer stops. It is considered that the punt return player fumbled the football on the 1 yard line, and it went out of bounds through the end zone, the punt return player loses the football. The punting player gets the football back and starts the drive from his own 20 yard line.

TOUCHBACK—When the football lands out of bounds or on the end zone after a punt has been made, its a touchback. If the football lands out of bounds, the timer stops, there is no punt return, the receiving player starts the drive from his own 20 yard line. If the football lands on the end zone, the receiving player can choose whether to make a punt return or to decline (see PUNT).

KICK—The kick (kickoff) is made from the 35 yard line (kicking player) to start the game, the second half, after a touchdown and after field goal has been scored. To kick the football, the player rolls the kick-punt die one time per kick, and the number it shows after the roll, 35, 40, 45, etc., represents the amount of yards of the kick. After a kick the timer keeps running.

KICK RETURN—To make a kick return, the receiving player rolls the yardice one time after each kick. The receiving player has to roll the yardice a second time, only if he rolls a "double 4" (44) the first time. The total number of the yardice of one or two rolls, represents the amount of yards of the kick return. After a kick return, the timer stops, then the kick return player starts the drive. If, after counting the total yardice number of a kick return the football lands on the end zone of the kicking player, the kick return player scores a touchdown. If, after counting the total yardice number of a kick return the football lands out of bounds, out of the field, its a touchback, the timer stops. It is considered that,the kick return player fumbled the football on the 1 yard line and it went out of bounds through the end zone. The kick return player loses the football, the kicking player gets the football back and starts the drive from his own 20 yard line.

ONSIDE KICK—After scoring a touchdown or a field goal, the offense kicking player can attempt to get the football back by making an onside kick instead of a kick (kickoff). To make an onside kick, the kicking player rolls the yardice one time instead of the kick-punt die. If, after making an onside kick the kicking player rolls a yardice number 7 or 11, he gets the football back and after counting the yards, 7 or 11, the timer stops, then he starts the drive. If, after making an onside kick the kicking player does not roll a yardice number 7 or 11, the receiving player gets the football on the 45 yard line of the kicking player, the timer stops, from there the receiving player starts the drive. There's no kick return.

PENALTY—When an offense or defense player forgets to set, or sets his play on the wrong chart, its a 10 yard offside penalty. The timer stops. In a penalty situation, the offended player can choose whether to accept or to decline the penalty to the best of his advantage. The penalized player immediately shows his play (if any). IF the offense forgets to et his play, the penalty has to be accepted by the defense. If a penalty occurs on or inside the 10 yard line of the penalized player, the penalty is only half the distance from the yard line where the football is at to the goal line (first touchdown dot). If the football is on the 10 or 9 yard line, the football is placed on the 5 yard line and so on. If a penalty is accepted, the plays do not count. If a penalty is declined, the plays count. In a penalty, the down changes or remains the same according to the situation.

OVER-THROW (RUN OR PASS)—When the offense player rolls the yardice and the number he gets is higher than the number of yards that he needs to make a completion, its an over-throw run or pass. In an over-throw, the plays do not count, but the down does. The timer stops. The offense cannot make an over-throw if he sets a Run-Q.B. play since the yardice number count as units from 0 to 9 (see Q.B. Rule).

BOMB PLAY—During the last two minutes of a game, the offense player can make a bomb play attempt only if he is losing or tied and only if the football is on the defense's territory including the 50 yard line. To make a bomb play attempt, the offense has to let the defense know that he is going to make a bomb play attempt. He then sets a Pass-play (Pass-T.E.; or Pass-W.R.), on the offense chart. Then he places the white die, blank side up on the playing board and after the defense sets his play, the offense rolls the black die only. The number, if any, on the black die is multiplied by 10 since the white die is blank. In a bomb play attempt, the defense has to set a Cover-play (Cover-T.E.; or Cover-W.R.) on the defense chart, particularly on any of the number 0, 10, 20, 30, 40. If after the roll, the defense does not match-up either the play or the yardice number of the offense, the bomb play attempt is good. The offense advances the football according to the yardice number. If the defense does match-up either the play or the yardice number, the bomb play attempt is not good. The offense does not advance the football. If the defense does match-up both the play and the yardice number, its an interception. The offense loses the football after counting the yardice number, if any. The offense can make only one bomb play attempt for each new drive. A bomb play can also be made during the last two minutes of overtime.

REVERSE PLAY—When the offense sets a Run-Q.B. play, and rolls a high number, white die is blank or any double, and the defense does not match-up the yardice number, the offense can choose whether to use the Q.B. Rule or to make a reverse play. If the offense chooses to use the Q.B. Rule, then the yardice number counts as units from 0 to 9 (see Q.B. Rule). If the offense chooses to make a reverse play, he calls "REVERSE," then he sets a new play along with the Run-Q.B. play, on the offense chart. He does not roll the yardice, and immediately shows both plays (Run-Q.B. play and new play). If the defense does not match-up either of both plays, then the reverse play is good. The number on the black die is multiplied by 10. The offense advances the football according to the yardice number. If the defense does match-up either of both plays, then the reverse play is not good. The offense does not advance the football. In a reverse play, the defense does not change or sets a new play. The reverse play is used by choice of the offense player to try to convert the low number units of a Run-Q.B. play into a high number.

LATERAL PLAY—When the offense sets a Run-Q.B. play and rolls a yardice number "0," double blank, and the defense does not match-up the yardice number, 0, the offense calls LATERAL, and immediately shows his play (Run-Q.B.) and removes it from the board. If the defense does match-up with Blitz-Q.B., the play ends. The defense does not show or removes his play from the board if he does not match-up and the play continues. To make the lateral play attempt, the offense sets a new play, the defense does not change or sets a new play, after setting the new play, the offense rolls the yardice a second time within the same down of a roll "0." If after the roll, the defense does not match-up either the play or the yardice number, the lateral play is good. The offense advances the football according to the yardice number. If after the roll, the defense does match-up either the play or the yardice number, or both, the lateral play is not good. The offense does not advance the football. It could be an incomplete run-pass, or a fumble, or an interception. A lateral play attempt cannot be made if the football is on or inside the 34 yard line of the defense.

The players do not set plays when attempting to score; field goals and extra points or when making; punts, punt returns, kicks (kickoffs, free kicks, onside kicks), kick returns and interception returns. When a player forgets to make a punt or a kick or an interception return, the return is considered as declined.

POINTS—The players get points when scoring the following: touchdown—6 points; field goal—3 points; safety—2 points. Extra points are as follows: via run or pass—2 points; extra point for via kick—1 point.

TIME—The rules of the present invention allow the game to last 1 hour and is divided into two halves, each having two periods or quarters of 15 minutes. Before starting a game, the players can choose whether to use the timer or to let the 15 minutes of each quarter run down, stopping the timer only on time outs and 2 minute warnings. If an extra player is available, it is suggested for him to have control of the timer during the game. At the end of the first three quarters, the players exchange sides (optional) on the playing board. At the end of the first half, there is a break or halftime. During the halftime, the players exchange sides (optional) and get ready for the second half (the players choose the length of time of the halftime). When a player wants to stop the timer to change a play or to warm-up the die(s), or just to save time, he can call time out. When a player calls timer out, he places a marking peg on the marker of downs chart, on the respective time out number 1, 2, 3, then the player, playing defense at the time, stops the time and turns over the time out timer. The time out lasts around 1 minute. When the time out timer expires, the defense player sets the timer to run again. A time out can be called only after counting the gained or lost yards, if any. Each player gets three times outs per half, only two in overtime,. If they are not used, they cannot be carried over to the next half. The defense player stop the timer when the 2 minute warning occurs, the last 2 minutes of each half, then he turns over the time out timer and when it expires he sets the timer to run again. The offense can let the last second of the game run down by setting the play Run-Q.B. facing upwards, with the drawing of the helmet facing downwards, then both players follow the procedure of a regular play. After the roll, the offense does not gain or lose any yards and the timer keeps running The defense cannot make any football situation sack, fumble, etc., even if he does match-up the yardice number. This procedure is repeated if necessary. To stop the timer, a timer out has to be called. The game ends when the total time, 1 hour, expires. If the game score is tied when the time expires, the players play overtime. To play overtime, the players select offense and defense by tossing up a coin. After the selection, the players play overtime in one quarter of 15 minutes. The first player to score during the quarter wins the game. If after the quarter expires, the tie persists, the game ends as tied.

According to preferred rules of the present invention, the winner of the game is the player that scores the most points when the total time expires Thus, it can be seen that at least all of the stated objectives have been achieved Obviously, many modifications and variations of the present invention are possible in light of the above teachings. It is therefore to be understood that, within the scope of the appended claims, the invention may be practiced otherwise than as specifically described.

I claim:

1. A board game for playing a simulated football game, comprising:

a game board including a representation of a football field having yard line and goal line indicia;

an offensive play chart disposed on the board and having a number of associated offensive playing pieces each indicating a selected offensive play;

a defensive play chart disposed on the board, said defensive play chart having numerals representing yardages, a number of associated defensive playing pieces each indicating a selected defensive play, and a pair of yardage dice having indicia associated with yardages shown on said defensive play chart;

a field goal chart disposed on the board and having an associated die selected from a number of field goal dice and determined by an offensive player's position on the field;

an extra point chart disposed on the board and having an associated extra point die; and a kick-punt chart disposed on the board and having an associated kick-punt die.

2. The board game of claim 1 further including a marker of down chart disposed on the board and having an associated marker.

3. The board game of claim 1 wherein a pair of offensive play charts are disposed on opposite lateral sides of said field.

4. The board game of claim 1 wherein a pair of defensive play charts are disposed on opposite lateral sides of said field.

5. The board game of claim 1 wherein said yardage dice each include blank surfaces.

6. The board game of claim 1 wherein said field goal dice each include blank surface.

7. The board game of claim 1 wherein said extra point die includes a blank surface.

8. The board game of claim 1 wherein said kick-punt die includes no blank surfaces.

* * * * *